United States Patent [19]

Zeilinger

[11] Patent Number: 4,829,730

[45] **Date of Patent: * May 16, 1989**

[54] COUNTERTOP SEALING SYSTEM

[75] Inventor: Alan Zeilinger, Cleveland, Ohio

[73] Assignee: Magic American Corporation, Cleveland, Ohio

[ * ] Notice: The portion of the term of this patent subsequent to Nov. 17, 2004 has been disclaimed.

[21] Appl. No.: 119,186

[22] Filed: Nov. 10, 1987

Related U.S. Application Data

[63] Continuation-in-part of Ser. No. 907,030, Sep. 15, 1986, Pat. No. 4,706,427.

[51] Int. Cl.[4] ..... E04H 1/00

[52] U.S. Cl. ..... 52/288; 52/35; 52/717.1

[58] Field of Search ..... 52/35, 36, 34, 278, 52/287, 288, 716–718, 242, 290, 255, 286, 732

[56] References Cited

U.S. PATENT DOCUMENTS

| | | | |
|---|---|---|---|
| 1,250,594 | 12/1917 | Knapp | 52/287 |
| 2,090,588 | 8/1937 | Witsell | 52/35 |
| 2,227,581 | 1/1941 | Henderson . | |
| 2,274,317 | 2/1942 | Bonnell | 52/287 |
| 2,300,084 | 10/1942 | Wright | 52/287 X |
| 2,303,864 | 12/1942 | Reason | 52/287 X |
| 2,541,768 | 2/1951 | Keller . | |
| 2,915,794 | 12/1959 | Hillmann . | |
| 2,994,905 | 8/1961 | Franker, Jr. | 52/732 X |
| 3,464,177 | 9/1969 | Amato | 52/287 |
| 4,520,605 | 6/1985 | Budd | 52/287 |
| 4,601,149 | 7/1986 | Dokan | 52/287 |
| 4,642,957 | 2/1987 | Edwards | 52/288 X |
| 4,706,427 | 11/1987 | Zeilinger | 52/288 |

FOREIGN PATENT DOCUMENTS 2060243 6/1972 Fed. Rep. of Germany .

OTHER PUBLICATIONS

OBO Brochure, "Decorative Seals and Trims Finish the Job Off Beautifully".

OBO Brochure, "Decorative Seals and Trims".

*Primary Examiner*—David A. Scherbel

*Assistant Examiner*—Richard E. Chilcot, Jr.

*Attorney, Agent, or Firm*—Renner, Otto, Boisselle & Sklar

[57] ABSTRACT

An improved decorative molding system for covering the joint formed between a countertop surface and an adjacent wall surface. The system includes a molding strip for covering the joint, the molding strip having an L-shape formed by a pair of integrally joined legs. The legs have respective outside surfaces together forming a gradually curved, generally concave front face of the strip and respective inside surfaces which are generally planar and substantially perpendicular. The legs have bifurcated inner portions together forming outside and inside walls. The outside and inside walls are relatively gradually and sharply curved, respectively, and merge together at their outer ends to define therebetween a hollow cavity which is generally triangular in cross-sectional shape. Each leg has a flared outer edge portion which angles inwardly with respect to the planar extent of the inside surface of the leg. The system also includes a corner piece for covering a gap between adjacent ends of sealing strips which extend generally perpendicularly with respect to one another, an end cap for closing an end of the molding strip, and a joiner piece for closing a gap between inline sealing strips.

22 Claims, 5 Drawing Sheets

COUNTERTOP SEALING SYSTEM

RELATED APPLICATION DATA

This application is a continuation-in-part of U.S. patent application Ser. No. 907,030, filed Sept. 15, 1986 and entitled "Sealing System", now U.S. Pat. No. 4,706,427 dated Nov. 17, 1987.

FIELD OF THE INVENTION

The invention herein described relates generally to a decorative molding system and components thereof for covering and preferably sealing the juncture of two or more surfaces intersecting generally at right angles with respect to one another. More particularly, the invention relates to a system and components thereof for covering and preferably sealing the crack where a countertop or other horizontal surface meets an adjacent wall or other vertical surface.

BACKGROUND

Many counter installations have unsightly cracks where the countertop and adjacent wall surfaces meet. These cracks may actually be relatively large gaps caused by rough counter edges or a poor fit. These cracks and gaps can collect and trap debris and dirt which is difficult to clean out. Also, liquids may run down into the cracks, and this may result in such problems as warping, peeling wallpaper and even structural damage. A damp dirty crack also is an ideal location for mildew growth.

Decorative moldings or trims heretofore have been devised to cover and/or seal the joint between countertop and adjacent wall surfaces, as well as joints formed between other substantially mutually perpendicular surfaces. One known decorative trim and seal system for work top surfaces employs a two-piece strip assembly including a decorative front section and a base section. The base section is secured by screws to the countertop and then the front section is pressed onto the base section to cover the joint between the countertop surface and adjacent wall surface. Corner joints are provided for use at internal wall corners and end caps are provided to close exposed ends of the strip assembly.

Also known are flexible plastic sealing strips for sealing the gap between a top surface of a bathtub and an adjacent wall surface. These strips are generally L-shape in cross-section and waterproof adhesive is applied to the back of the upright leg for bonding the sealing strip to the wall. At corners, the ends of the strips were mitered for desired abutment, but this was time consuming and usually required a miter box, thereby increasing installation costs. Moreover, a good fit is difficult to obtain with a mitered joint and consequently there was minimal assurance of a good seal at the corner. These problems, however, are avoided by the improved sealing system disclosed in copending U.S. patent application Ser. No. 907,030, filed Sept. 15, 1986 and entitled "Sealing System" now U.S. Pat. No. 4,706,427. This system includes a unique corner piece which overlaps the adjacent ends of the sealing strips at a corner. The system also includes a unique end cap for sealing exposed ends of the plastic sealing strips.

Still other types of sealing strips and/or systems are known and disclosed in U.S. Pat. Nos. 2,303,864 and 2,541,768. Notwithstanding, there remains a continuing need for improved systems and components which have their own attendant advantages not attainable by existing systems and components.

SUMMARY OF THE INVENTION

The present invention provides an improved decorative molding system for covering the joint formed between a horizontal surface, such as the top surface of a counter, and an adjacent vertical surface, such as a wall surface. The system includes a molding strip for covering the joint, the molding strip having an L-shape formed by a pair of integrally joined legs. The legs have respective outside surfaces together forming a gradually curved, generally concave front face of the strip and respective inside surfaces which are generally planar and substantially perpendicular. The legs have bifurcated inner portions together forming outside and inside walls. The outside and inside walls are relatively gradually and sharply curved, respectively, and merge together at their outer ends to define therebetween a hollow cavity which is generally triangular in cross-sectional shape. The outside and inside walls are substantially the same uniform thickness, and each leg has a flared outer edge portion which angles inwardly with respect to the planar extent of the inside surface of the leg. For installation, the inside surface of at least one of the legs is provided with an adhesive strip for adhering to the horizontal or vertical surface adjacent the joint thereby to hold the strip in place with outer edges of the flared edge portions engaging the horizontal and vertical surfaces to cover the joint.

The system also includes a corner piece for covering and preferably sealing a gap between adjacent ends of sealing strips which extend generally perpendicularly with respect to one another at a corner formed between intersecting wall surfaces. The corner piece comprises a pair of generally curved walls extending generally at right angles with respect to one another. Each wall has an outer end portion recessed at its inner side to form a cover flange for overlapping an adjacent end of a respective molding strip. The cover flange is of substantially uniform thickness and substantially conforms to the outside contour of the molding strip. The cover flange also has flared edge portions for overlapping and forming continuations of the flared edged portions of the molding strips.

Another component of the system is an end cap for closing an end of the molding strip. The end cap includes a generally L-shaped flange for overlapping a portion of the outside surface of the molding strip at the end thereof, and a generally L-shaped end wall extending from the L-shaped flange. The end wall has generally perpendicular edges for abutting the horizontal and vertical surfaces, respectively, and a pair of fingers extend perpendicular to the end wall and from respective edges of the end wall for engaging inside surfaces of the molding strip. In accordance with the invention, the end cap also comprises a web extending between and integrally joining together the fingers to form an L-shaped tongue insertable between the molding strip and the horizontal and vertical surfaces.

The system also includes a joiner piece for covering a gap between adjacent ends of in-line sealing strips.

The foregoing and other features of the invention are hereinafter fully described and particularly pointed out in the claims, the following description and annexed drawings setting forth in detail certain illustrative embodiments of the invention, these being indicative, however, of but a few of the various ways in which the principles of the invention may be employed.

DETAILED DESCRIPTION

Figure 1:
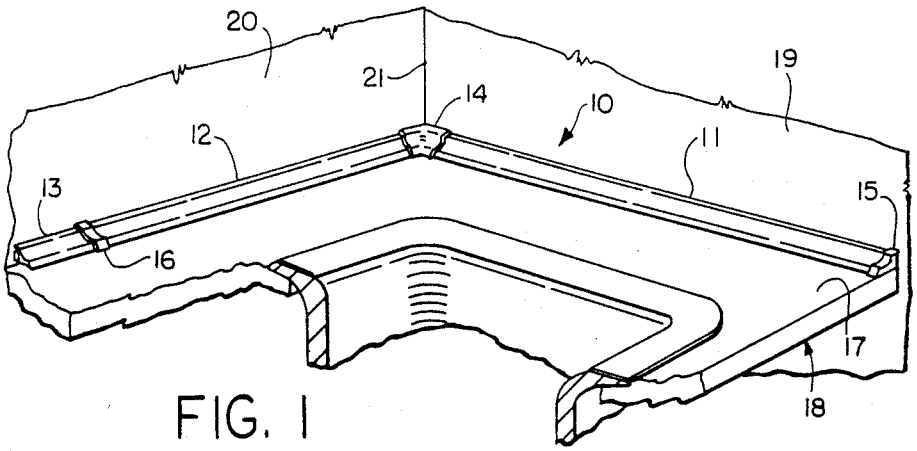
FIG. 1 is a perspective illustration of a decorative molding system according to the present invention, the system including plural sealing strips, an end cap, a corner piece and a joiner piece for covering the joints between a countertop and adjacent wall surfaces.

Referred now in detail to the drawings, a preferred embodiment of decorative molding system according to the invention is indicated generally at 10 in FIG. 1. The molding system 10 comprises sealing strips 11–13, a corner piece 14, an end cap 15 and a joiner piece 16. In the exemplary installation illustrated in FIG. 1, the several components are assembled to cover and preferably seal the longitudinal joints formed between the horizontal top surface 17 of counter 18 and adjacent vertical wall surfaces 19 and 20 which intersect at a corner 21. Accordingly, the illustrated system may be referred to as a countertop sealing system, this being a preferred application of the invention. As is typical of most corner countertop installations, the wall surfaces 19 and 20 are substantially perpendicular with respect to one another and also to the countertop surface 17.

In the illustrated installation, sealing strip 11 is installed to cover the crack or joint where countertop surface 17 meets wall surface 19. The sealing strip 11 extends approximately from the corner 21 to the front edge of the countertop surface 17. The end cap 15 is installed to cover the exposed end of the sealing strip 11, thereby to prevent dirt from entering between the sealing strip and the wall/counter. The end cap also provides an aesthetic termination for the sealing strip.

At its end adjacent the corner 21, sealing strip 11 is overlapped by the corner piece 14. The corner piece 14 also overlaps the adjacent end of sealing strip 12 which extends along the covers the joint between the countertop surface 17 and the other wall surface 20. As will be appreciated, the corner piece eliminates the need to miter and butt the ends of the sealing strips 11 and 12 while providing a smooth, continuous look and a seal at the corner.

On occasion, a joint to be covered may be of a length exceeding the length of an available sealing strip. In these instances, two or more sealing strips may be installed end-to-end. As seen in FIG. 1, sealing strip 13 is installed in line with the sealing strip 12 and the adjacent ends thereof are overlapped by a joiner piece 16. Like the corner piece 14, the joiner piece provides a smooth, continuous transition between adjacent ends of sealing strips. The joiner piece covers and seals the gap between adjacent ends of the in line sealing strips 12 and 13 while the corner piece covers and seals the gap between adjacent ends of sealing strips 11 and 12 which extend generally perpendicularly with respect to one another at the corner 21 formed between the intersecting wall surfaces 19 and 20.

The components of the system 10, i.e., the sealing strips 11–13, corner piece 14, end cap 15 and joiner piece 16, are all formed of a hard, nearly rigid, material. Preferably the material is a plastic or plastic-like material having sufficient rigidity or stiffness for maintaining the cross-sectional profile of the components during installation and use, while permitting some gradual flexing of the strip along its length. The sealing strips preferably are extruded and cut to length, and the other components preferably are molded to shape. The components also may contain a mildewcide to resist mildew growth.

The Sealing Strips

Figure 2:
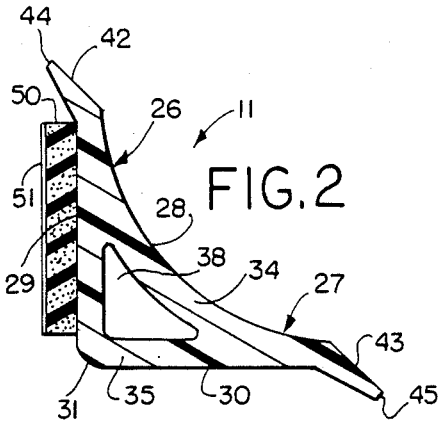
FIG. 2 is an enlarged sectional view through one of the sealing strips prior to installation.
Figure 3:
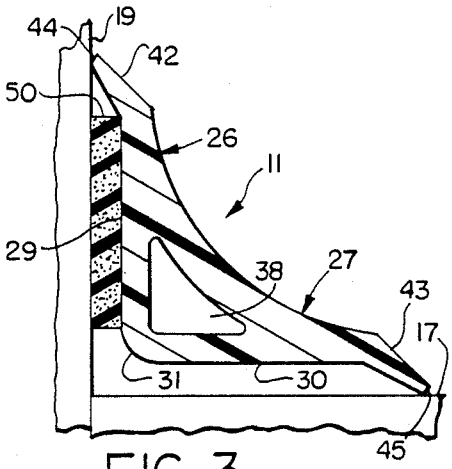
FIG. 3 is a view similar to FIG. 2 but showing the sealing strip installed.

In FIGS. 2 and 3, details of the sealing strips 11–13 are shown by representative example of the sealing strip 11, such illustration and the following description being equally applicable to the other sealing strips 12 and 13. In FIG. 2, the sealing strip 11 is shown prior to installation whereas FIG. 3 shows a desired installation of the strip at the intersection of the countertop surface 17 and wall surface 19.

As seen in FIGS. 2 and 3, the sealing strip 11 generaly is L-shape in cross-section, such cross-sectional shape preferably being uniform along the length of the strip. The two legs of the L-shape sealing strip 11, indicated generally at 26 and 27, are generally perpendicular with respect to one another. At their outer sides, the legs 26 and 27 have gradually curved outside surfaces which merge together and form a generally concave outside or front face 28 of the sealing strip which is free of sharp or abrupt angles. At their inner sides, the legs 26 and 27 have respective inside surfaces 29 and 30 which are generally flat or planar. The inside surfaces 29 and 30 intersect at a relatively sharp or right angle corner 31 which may be radiused as shown.

According to the invention, the gradually curved, generally concave front face 28 and the relatively sharp angle between the inside surfaces 29 and 30 of the legs 26 and 27 are obtained by a bifurcated leg construction at the middle of the sealing strip 11. As shown, adjacent inner portions of the legs are bifurcated and together form outside and inside walls 34 and 35 which merge together at their outer ends and form single wall outer portions of respective legs 26 and 27. The outside wall 34 is of relatively uniform thickness and is gradually curved for providing the gradually curved, generally concave outside face 28 of the sealing strip. The inside wall 35, which also may be of relatively uniform thickness, has a relatively sharp or right angle bend at corner 31 and forms inner portions of the generally planar inside surfaces 29 and 30 of the legs 26 and 27.

As result of their relative configurations, the outside and inside walls 34 and 35 form or define therebetween a cavity or hollow space 38 extending along the length of the sealing strip 11. This cavity 38 generally has a triangular shape as can be seen in FIGS. 2 and 3. As will be appreciated, the provision of this cavity minimizes the amount of material needed to form the sealing strip 11 and provides a corresponding reduction in material costs. Another advantage is the elimination of a thick middle portion of the strip which may cause shrinkage problems. As can be seen in FIGS. 2 and 3, the major solid portions of the sealing strip, i.e., outside wall 34, inside wall 35 and outer portions of the legs 26 and 27, are approximately the same thickness, although there is a slight enlargement in thickness at the union between the inside and outside walls and the outer portions of the legs 26 and 27.

The legs 26 and 27 of the sealing strip 11 respectively have outer edge portions 42 and 43 forming sealing lips which angle inwardly from the major extent of the respective legs. Preferably the edge portions extend inwardly at an angle of about 30° to the plane of the respective inside surfaces 29 and 30 of the legs and project inwardly from the inside surfaces about 0.032 to 0.035 inch. The outer edge portions 42 and 43 ideally taper to narrow or feathered edges 44 and 45, respectively.

Regarding further details of the illustrated preferred embodiment of a sealing strip according to the invention, the sealing strip 11 is symmetrical with respct to the line or plane which bisects the angle between the legs 26 and 27. Each leg may have a length of approximately 0.305 inch with the generally planar inside surface thereof having a length of approximately 0.215 inch. Also, the total span of the sealing strip from edge 44 to edge 45, taken in a direction generally perpendicular to the line bisecting the legs, may be approximately 0.5 inch, and the outside and inside walls 34 and 35 may be approximately 0.030 inch in thickness. The sides of the cavity 38 extending parallel to respective inside surfaces 29 and 30 each may extend approximately one-half the length of the respective inside surface and approximately one-third the total length of the respective legs.

For securing the sealing strip 11 in place, a double sided adhesive foam strip 50 is applied to the inside surface 29 of leg 26. The width of the adhesive strip 50 preferably is about equal the width of the inside surface 29 to which one adhesive surface of the strip is adhered. The opposite or exposed adhesive surface of the adhesive strip 50 may be covered by a protective releast strip 51. The release strip 51 is removable to permit installation of the sealing strip 11 as shown in FIG. 3.

After removal of the protective strip 51, the sealing strip 11 may be pressed against the countertop 17 and against the wall 19 with the exposed adhesive side of the adhesive foam strip 50 adhering to the wall surface 19 to hold the strip in place. The adhesive foam strip 50 holds the sealing strip 11 in place with its outer edges 44 and 45 flush against the wall surface 19 and countertop surface 17, respectively. The edges thereby provide a barrier to entrance of water and debris between the strip and the wall/countertop surfaces. Moreover, the inwardly angled flared top edge portion 42 of the upright leg 26 functions to cover the adhesive foam strip 50 to eliminate or minimize exposure to water or moisture. This is desirable for more secure and longer lasting adherence of the sealing strip to the wall surface 19, even though a waterproof adhesive preferably is used.

When properly installed, the leg 26 of the sealing strip 11 is generally upright and parallel to the vertical wall surface 19 and the other leg 27 is generally horizontal and parallel to the countertop surface 17. More particularly, the inside surfaces 29 and 30 of the legs extend generally parallel to the vertical wall surface 19 and countertop surface 17, respectively. Consequently, the inside surface 29 may be referred to as a back surface of the sealing strip and the inside surface 30 may be referred to as a bottom surface of the sealing strip. At the front side of the sealing strip, the outside face 28 provides a curved concave profile while the outside surfaces of the angled outer edge portions 42 and 43 blend this curved concave profile into the adjacent wall and countertop surfaces.

Although an optimal cross-sectional shape of the sealing strip 11 is shown in FIGS. 2 and 3, the actual shape of the sealing strip may vary because of shrinkage and manufacturing variances while still preserving the basic characteristic features of the sealing strip's cross-section. The outside wall 28, for example, may have a somewhat tighter bend than that shown, but one still substantially less than the relatively sharply angled bend in the inside wall 35. The transition from the outside face 28 to the outer surfaces of the edge portions 42 and 43 may be less distinct and more gradual than shown, as may the transition between the inside surfaces 29 and 30 and respective inside surfaces of the outer edges portions 42 and 43. The inside surfaces 29 and 30 also may be slightly curved, although still substantially or generally flat.

The End Cap

Figure 6:
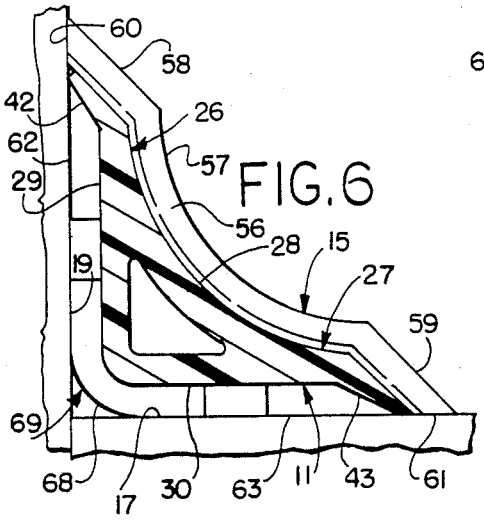
FIG. 6 is a sectional view taken along the line 6—6 of FIG. 4.

Referring now to FIGS. 4–7, the end cap 15 includes a generally L-shape end wall 55 and a cover flange 56 flush with the front or outside edge of the end wall 55. The cover flange 56 generally is of uniform thickness and is shaped to the outside contour of the sealing strip as best seen in FIG. 6. That is, the cover flange 56 has a gradually curved, concave middle portion 57 and flared edge portions 58 and 59. When installed at the end of sealing strip 11, the middle portion 57 overlies the outside face 28 of the sealing strip and the flared edge portions 58 and 59 overlie respective outer edge portions 42 and 43 of the legs. The edge portions 58 and 59 of the cover flange terminate at edge surfaces 60 and 61 which are flush with respective inside edge surfaces 62 and 63 of the end wall 55. At its end opposite the end wall, the cover flange 56 has a beveled front rim surface 64 extending from edge surface 60 to edge surface 61. The beveled rim surface terminates endwise at a narrow or feathered end surface 65 and provides a smooth transition from the front face of the cover flange to the front face 28 of the sealing strip.

Figure 4:
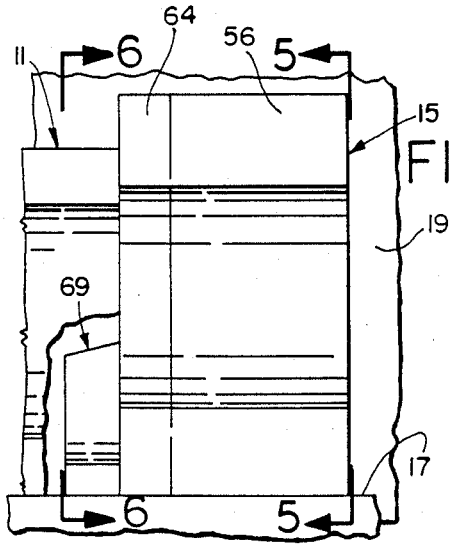
FIG. 4 is an enlarged elevational view, partly broken away, showing the end cap of FIG. 1 installed at the end of one of the sealing strips.
Figure 5:
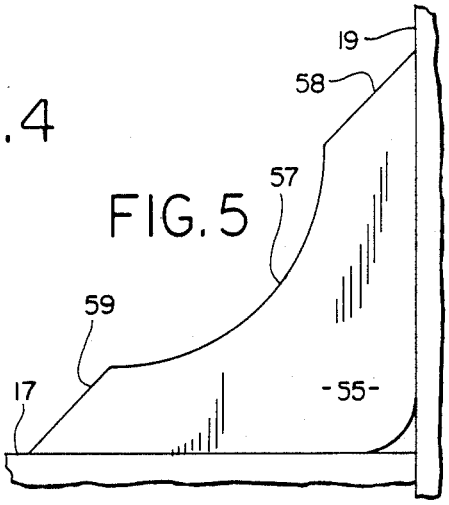
FIG. 5 is an end elevational view of the end cap looking from the line 5—5 of FIG. 4.
Figure 8:
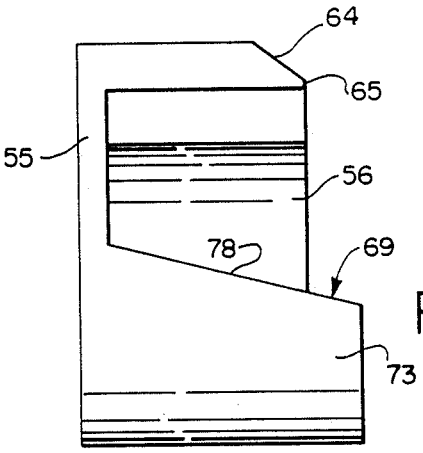
FIG. 8 is a rear elevational view of the end cap looking from the line 8—8 of FIG. 7.

The inside edge surfaces 62 and 63 of the end wall 55 generally extend at right angles to one another and may intersect at a gradually curved corner surface 68. In this corner region, there is provided an L-shape tongue 69 projecting from the end wall 55. The tongue 69 and cover flange 56 extend at approximately right angles to the end wall 55 in the same direction. As best seen in FIGS. 4 and 8, the tongue may project from the end wall a distance slightly greater than that of the cover flange. The tongue and cover flange form therebetween a socket-like area 70 into which the end of a sealing strip 11 may be inserted.

Figure 7:
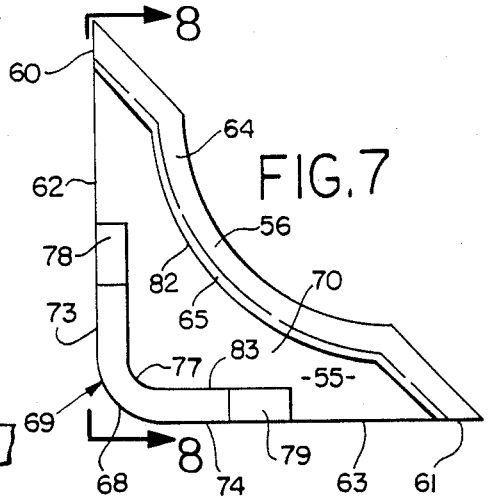
FIG. 7 is a view similar to FIG. 6 but showing the end cap with the sealing strip removed.

The legs 73 and 74 of the L-shaped tongue 69 have inside surfaces which are flush with the corresponding inside edge surfaces 62 and 63 of the end wall 55. The tongue legs 73 and 74 extend part way along the inside edge surfaces of the end wall and are joined by a curved web portion 77 which may extend along the curved corner 68. As seen in FIGS. 7 and 8, the side edges 78 and 79 of the fingers opposite the web portion 77 may be angled to provide a taper to the tongue.

Each leg 73, 74 of the tongue forms a finger for insertion behind the respective leg 26, 27 of the sealing strip 11. The fingers hold the cover flange 56 of the end cap against the outside face 28 of the sealing strip. When installed as shown in FIG. 4, the fingers 73 and 74 extend behind the legs of the sealing strip and are trapped between the inside surfaces 29 and 30 of the legs 26 and 27 and the wall surface 19 and countertop surface 17, respectively.

Although a friction fit may be employed to hold the end cap 15 in place, preferably the end cap is secured to the end of the sealing strip 11 and to the wall surface 19 and/or countertop surface 17 by a suitable adhesive or an adhesive strip. For example, an adhesive strip such as thin double-sided adhesive tape may be applied to the inside face 82 of the cover flange 56 for adherence to the outside face 28 of the sealing strip when the end cap is installed on the end of the sealing strip. Alternatively or additionally, a double-sided adhesive strip may be used along the interior surface 83 of the tongue to adhere the tongue to the inside surfaces 29 and 30 of the sealing strip. If desired, a suitable cement or adhesive putty may be employed in place of adhesive strips.

The Corner Piece

Figure 9:
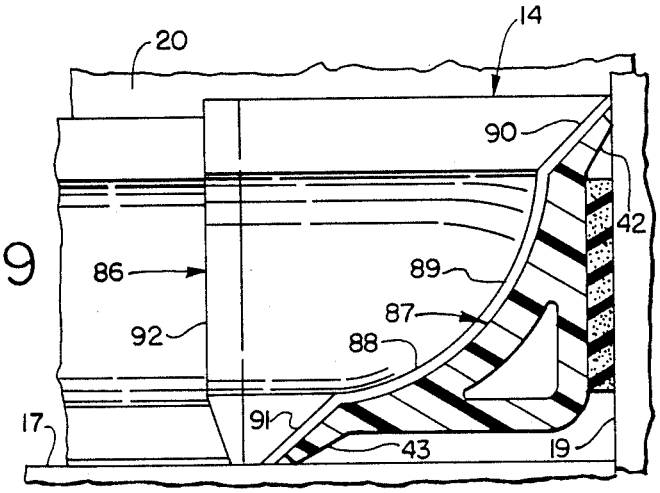
FIG. 9 is an enlarged part elevational, part sectional view showing the corner piece of FIG. 1 assembled to adjacent ends of two of the sealing strips extending at right angles with respect to one another.
Figure 10:
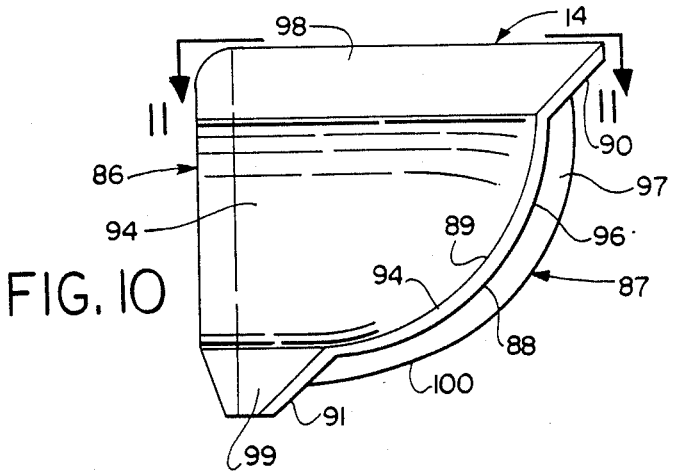
FIG. 10 is a view generally similar to FIG. 9 but showing the corner piece with the sealing strips removed.
Figure 11:
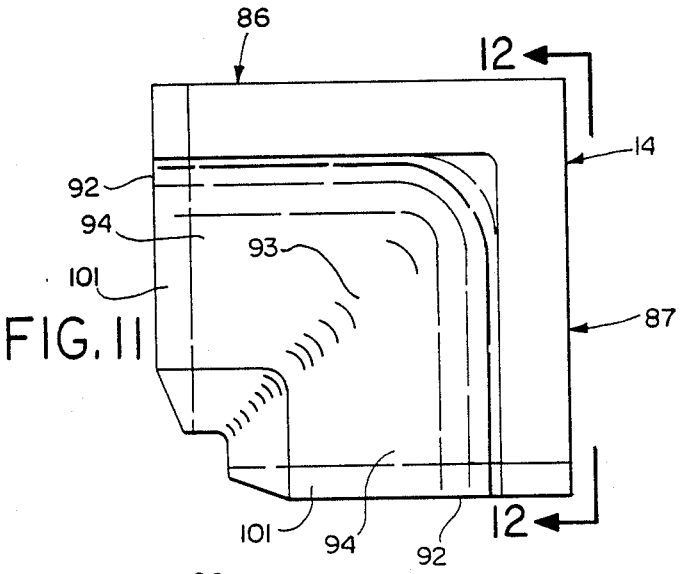
FIG. 11 is a top plan view of the corner piece looking from the line II—II of FIG. 10.
Figure 12:
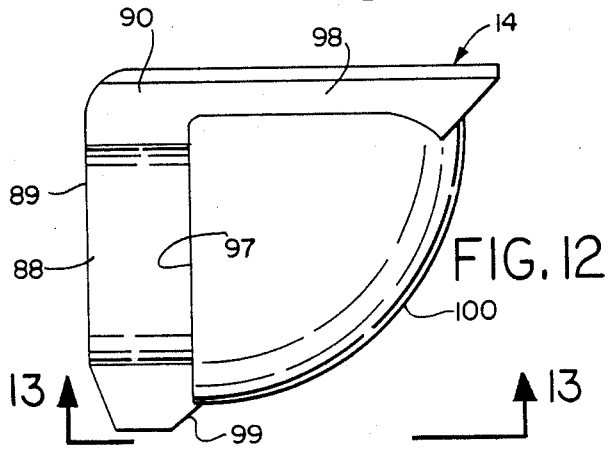
FIG. 12 is an elevational view of the corner piece looking from the line 12—12 of FIG. 11.
Figure 13:
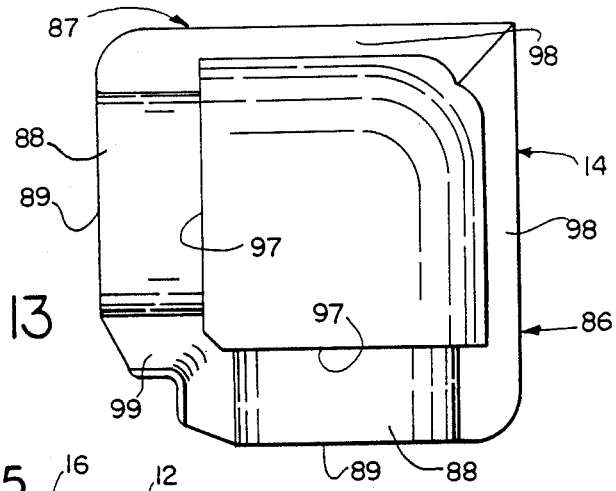
FIG. 13 is a bottom view of the corner piece looking from the line 13—13 of FIG. 12.
Figure 14:
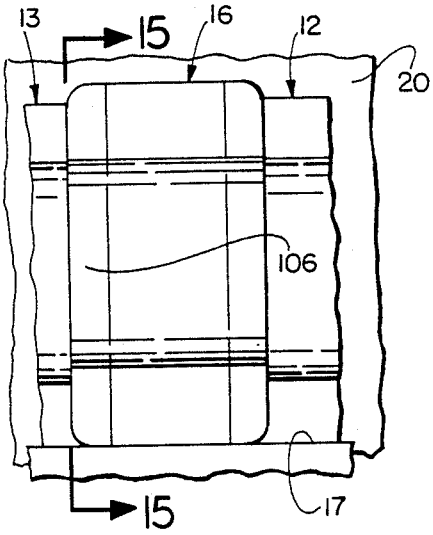
FIG. 14 is an enlarged elevational view showing the joiner piece in overlapping engagement with adjacent ends of a pair of the sealing strips assembled in line with one another.
Figure 15:
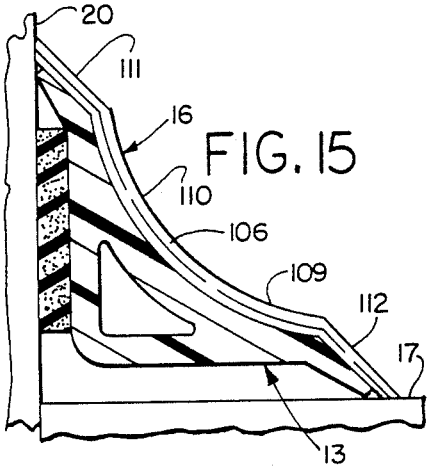
FIG. 15 is a section through the installation of FIG. 14 taken along the line 15—15 thereof.
Figure 16:
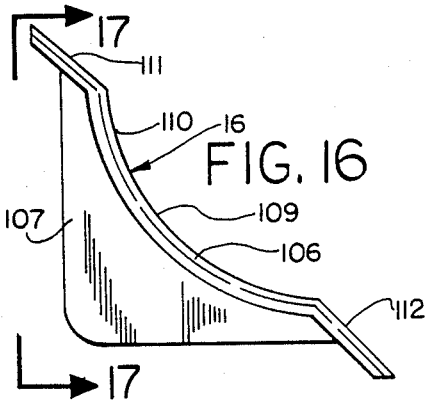
FIG. 16 is a view generally similar to FIG. 15 but showing the joiner piece with the sealing strips removed.
Figure 17:
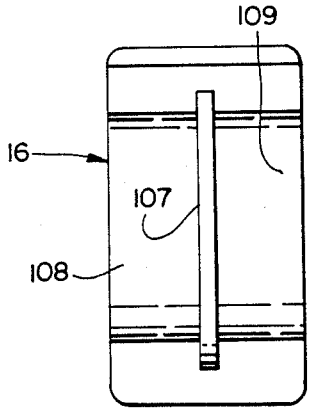
FIG. 17 is a rear elevational view of the joiner piece looking from the line 17—17 of FIG. 16.

Referring now to FIGS. 9–13, the corner piece 14 comprises a pair of generally curved walls 86 and 87 which extend generally at right angles with respect to one another. At its outer end, each wall 86, 87 is recessed at its inside to form a cover flange 88. Each cover flange 88 is of substantially uniform thickness and conforms to the outside contour of the adjacent sealing strip 11, 12 as seen in FIGS. 9 and 10. More particularly, each cover flange has a gradually curved, generally concave central portion 89 for overlying the outside face 28 of the adjacent sealing strip and flared outer edge portions 90 and 91 for overlying the flared edge portions 42 and 43 of the adjacent sealing strip.

The contour of the outside face 94 of each side wall 86, 87 continues generally from the outer end 92 of the side wall to the other end of the side wall where it merges with the outside face of the other side wall to form a blended corner region 93. At their intersection, the faces 94 are gradually curved and blended into one another. Except in the region of the outer peripheral portions of the flared edge portions 90 and 91 and the cover flanges 88, the side walls are generally of uniform thickness and convexly curved.

The inside surface 96 of each cover flange 88 terminates at a shoulder 97 except at the outer peripheral portions of the flared edge portions 90 and 91. These outer peripheral portions of the flared edge portions extend to the union between the two sides and form top and bottom lips 98 and 99 which project beyond the inside surface 100 of the side wall 86, 87 respectively along the top and bottom of the respective side wall. At its outer end, each cover flange has a beveled front rim surface 101 extending from top to bottom. The beveled rim surface 101 provides a smooth transition from the outside face 94 to the front face 28 of the sealing strip.

The corner piece 14 is installed at the corner 21 after the sealing strips 11 and 12 have been installed. The adjacent ends of the sealing strips terminate short of the corner by a distance permitting overlap of the end portions thereof by the cover flanges 88 of the corner piece. In the illustrated preferred embodiment, the sealing strips may terminate short of the wall surface from which they extend perpendicularly by a distance of about 0.438 inch, it being noted that the top edge of each side wall 86, 87 of the illustrated corner piece has a length of about 0.5 inch and that the shoulder 97 is spaced about 0.125 inch from the end 92 of the cover flange. After installation of the sealing strips 11 and 12, the corner piece 14 is secured in place by a suitable adhesive or adhesive strip(s). For example, an adhesive or adhesive strip may be applied along the inside surfaces 96 of the cover flanges for securement to the outside surfaces 28 of the adjacent sealing strips. The corner piece may also be secured in place by an adhesive strip or putty applied to the curved inside surfaces 100 of the side walls, if desired.

As above indicated, the cover flanges 88 mate with and overlie the adjacent ends of the sealing strips to close the gap between the ends of the sealing strips at the corner and further to provide a smooth, continuous look to the system at the corner.

The Joiner Piece

Referring now to FIGS. 14–17, the joiner piece 16 has a front wall 106 and a rearwardly extending divider wall 107 located centrally between opposite ends of the front wall. The divider wall divides the front wall into adjacent cover flanges 108 and 109 each conforming to the outside contour of respective adjacent sealing strips 12 and 13. As will be appreciated, the cover flanges of the joiner piece, corner piece and end cap all have essentially the same profile and size. Accordingly, each cover flange of the joiner piece has a gradually curved, generally concave middle portion 110 and flared outer edge portions 111 and 112.

For installation of the joiner piece 16, the in-line sealing strips 12 and 13 are installed with their adjacent ends spaced apart by a distance greater than the thickness of the divider wall 107 but less than the overall width of the joiner piece. The joiner piece then may be installed by inserting the divider wall between the strip ends and placing the cover flanges 108 and 109 into overlapped engagement with the ends of the sealing strips. The joiner piece may be secured in place by a suitable adhesive or adhesive strips applied, for example, to the back sides of the cover flanges.

Modified Sealing Strip

Figure 18:
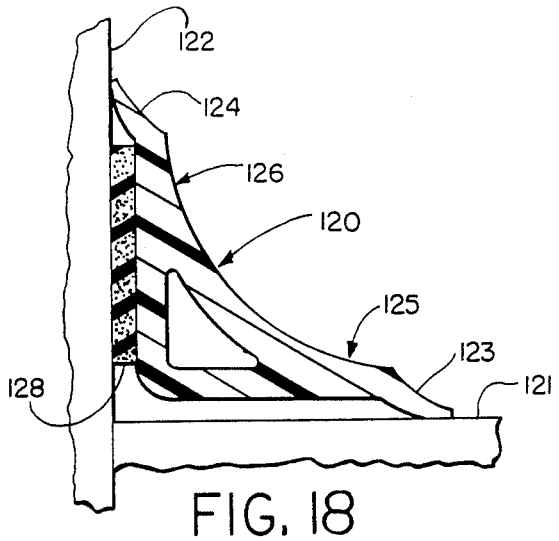
FIG. 18 is a sectional view showing a modified sealing strip installed at the joint between a countertop and adjacent wall surface.

In FIG. 18, a modified sealing strip 120 is shown installed at the joint where countertop surface 121 meets wall surface 122. The sealing strip 120 is essentially identical to the above described sealing strip 11 except for the outer edge portions 123 and 124 of the legs 125 and 126. The outer edge portions 123 and 124 are made of flexible material thereby to form flexible sealing lips whereas the sealing lips of the sealing strip 11 are stiff. The sealing strip 120 preferably is co-extruded from two different materials, i.e., a relatively hard, nearly rigid, material (after cure, of course) forming two major sections of the sealing strip and softer relatively flexible material forming two outer edge portions 123 and 124. The strip may be extruded to the strip cross-section shown in FIG. 2.

When installed as by means of adhesive strip 128, the flexible sealing lips 123 and 124 are resiliently pressed against the countertop surface 121 and the wall surface 122, respectively. As will be appreciated, the sealing strip 120 is better suited for use with surfaces having irregularities such as grouted joints of a tiled wall. The flexible sealing lips can conform to the irregularities to avoid or reduce the size of any gaps between the lips and the wall or countertop surface.

It is noted that the various components of the system according to the invention have been described with respect to a specific installation thereof at the interface between a countertop and two wall surfaces forming a corner. However, in general, one or more sealing strips may be used alone or in combination with one or more of the other components to cover the junction of two or more surfaces intersecting generally at right angles with respect to one another. Thus, by way of further example, the system may be used to seal the joints formed between horizontal top surfaces of tubs or sinks and adjacent vertical surfaces of walls or backsplashes.

Although the invention has been shown and described with respect to a certain preferred embodiment, equivalent alterations and modifications will occur to others skilled in the art upon the reading and understanding of the specification. The present invention includes all such equivalent alterations and modifications and is limited only by the scope of the following claims.

The invention claimed is:

1. A molding strip for covering the joint formed between a horizontal surface, such as the top surface of a counter, and an adjacent vertical surface, such as a wall surface, said molding strip having an L-shape formed by a pair of integrally joined legs, said legs having respective outside surfaces together forming a gradually curved, generally concave front face of said strip and respective inside surfaces which are generally planar and substantially perpendicular, said strip including a hollow cavity extending along the length of said strip, and each said leg having a flared outer edge portion which angles inwardly from the planar extent of said inside surface of the leg.

2. A molding strip as set forth in claim 1, wherein said legs have bifurcated inner portions together forming outside and inside walls, said outside and inside walls being relatively gradually and sharply curved, respectively.

3. A molding strip as set forth in claim 2, wherein said outside and inside walls merge together at their outer ends and define therebetween said hollow cavity.

4. A molding strip as set forth in claim 3, wherein said hollow cavity is generally triangular in cross-sectional shape.

5. A molding strip as set forth in claim 4, wherein said outside and inside walls are substantially the same uniform thickness.

6. A molding strip as set forth in claim 1, wherein said flared outer edge portion of each said leg tapers to a narrow edge.

7. A molding strip as set forth in claim 1, further comprising an adhesive strip on the inside surface of one said leg.

8. A molding strip as set forth in claim 7, in combination with said horizontal and vertical surfaces, said adhesive strip being adhered to one of said horizontal and vertical surfaces and operating to hold said strip in place with outer edges of said flared edge portions engaging said horizontal and vertical surfaces to cover the joint between said horizontal and vertical surfaces.

9. A molding system for covering the joints formed between a horizontal surface, such as the top surface of a counter, and adjacent vertical surfaces, such as wall surfaces, the horizontal and vertical surfaces being substantially mutually perpendicular and forming two longitudinal joints, one vertical joint and a corner at the intersection of the joints, said molding system comprising:

plural molding strips for covering the longitudinal joints, respectively, each molding strip having an L-shape formed by a pair of integrally joined legs, said legs having respective outside surfaces together forming a gradually curved, generally concave front face of said strip and respective inside surfaces which are generally planar and substantially perpendicular; and a corner piece comprising a pair of generally curved walls extending generally at right angles with respect to one another, each said wall having an outer end portion recessed at its inner side to form cover flange means from overlapping an adjacent end of a respective one of said molding strips, said cover flange means being of substantially uniform thickness and substantially conforming to the outside contour of said molding strip.

10. A molding system as set forth in claim 9, wherein said legs of each said molding strip have flared outer edge portions, and each said cover flange means has flared edge portions for overlapping and forming continuations of said flared outer edge portions of said molding strips.

11. A molding system as set forth in claim 10, further comprising an end cap for closing the end of one said molder strip, said end cap including generally L-shaped flange means for overlapping a portion of said front face of said molding strip at an end of said one molding strip, a generally L-shaped end wall extending from said L-shaped flange means, said end wall having generally perpendicular edges for abutting respective ones of the horizontal and vertical surfaces, and a pair of fingers extending perpendicularly to said end wall and from respective said edges of said end wall for engaging said inside surfaces of said one molding strip, said fingers being integrally joined together by a web extending therebetween to form with said fingers an L-shaped tongue insertable between said one molding strip and the horizontal and vertical surfaces.

12. A molding system as set forth in claim 11, wherein said flange means extends from said end wall a distance less than said tongue.

13. A system as set forth in claim 11, wherein said flange means has flared outer edge portions for overlapping and forming continuations of said flared outer edge portions of said one molding strip, and a gradually curved, substantially concave intermediate portion extending between said flared outer edge portions of said flange means for overlapping and forming a continuation of said front face of said one sealing strip.

14. A molding system as set forth in claim 9, wherein each one of said molding strips includes a hollow cavity extending along the length of said strip.

15. In an end cap for closing an end of a generally L-shape molding strip, said end cap including generally L-shaped flange means for overlapping a portion of an outside face of the molding strip at an end of the molding strip, a generally L-shaped end wall extending from said L-shaped flange means, said end wall having generally perpendicular edges for abutting respective ones of mutually perpendicular surfaces, and a pair of fingers extending perpendicularly to said end wall and from respective said edges of said end wall for engaging inside surfaces of the molding strip, the improvement comprising a web extending between and integrally joining together said fingers to form an L-shaped tongue insertable between the molding strip and the mutually perpendicular surfaces.

16. An end cap as set forth in claim 15, wherein said flange means extends from said end wall a distance less than said tongue.

17. An end cap as set forth in claim 15, wherein said flange means has flared outer edge portions for overlapping and forming continuations of flared outer edge portions of the molder strip, and a gradually curved, substantially concave intermediate portion extending between said flared outer edge portions for overlapping and forming a continuation of a gradually curved, generally concave front face of the molding strip.

18. An end cap as set forth in claim 15, in combination with said molding strip, said molding strip having an L-shape formed by a pair of integrally joined legs, said legs having respective outside surfaces together forming a gradually curved, generally concave front face of said strip and respective inside surfaces which are generally planar and substantially perpendicular.

19. A molding strip for covering the joint formed between a horizontal surface, such as the top surface of a counter, and an adjacent vertical surface, such as a wall surface, in combination with an end cap for closing an end of said molding strip, said molding strip having an L-shape formed by a pair of integrally joined legs, said legs having respective outside surfaces together forming a gradually curved, generally concave front face of said strip and respective inside surfaces which are generally planar and substantially perpendicular; and said end cap including generally L-shaped flange means for overlapping a portion of said front face of said molding strip at an end of said molding strip, a generally L-shaped end wall extending from said L-shaped flange means sid end wall having generally perpendicular edges for abutting respective ones of the horizontal and vertical surfaces, a pair of fingers extending perpendicularly to said end wall and from respective said edges of said end wall for engaging said inside surfaces of said molding strip, and a web extending between and integrally joining together said fingers to form an L-shaped tongue insertable between said molding strip and the horizontal and vertical surfaces.

20. A molding strip and end cap combination as set forth in claim 19, wherein said strip includes a hollow cavity extending along the length of said strip.

21. A molding strip for covering the joint formed between a horizontal surface, such as the top surface of a counter, and an adjacent vertical surface, such as a wall surface, in combination with another said molding strip and a joiner piece for covering a gap between adjacent ends of said molding strips when installed in line with one another, each said molding strip having an L-shape formed by a pair of integrally joined legs, said legs having respective outside surfaces together forming a gradually curved, generally concave front face of said strip and respective inside surfaces which are generally planar and substantially perpendicular; and said joiner piece including a front wall and a rearwardly extending divider wall means for positioning between said adjacent ends, said divider wall means dividing said front wall into a pair of oppositely extending cover flange means for overlapping respective end portions of said molding strips.

22. A molding strip and joiner piece combination as set forth in claim 21, wherein each said strip includes a hollow cavity extending along the length of said strip.

* * * * *